US007975351B2

(12) United States Patent
King

(10) Patent No.: US 7,975,351 B2
(45) Date of Patent: Jul. 12, 2011

(54) DOOR HANDLE FOR REFRIGERATORS AND/OR FREEZERS

(75) Inventor: Wilfried King, Ochsenhausen (DE)

(73) Assignee: Liebherr-Hausgeräte Ochsenhausen GmbH, Ochsenhausen (DE)

( * ) Notice: Subject to any disclaimer, the term of this patent is extended or adjusted under 35 U.S.C. 154(b) by 154 days.

(21) Appl. No.: 11/795,777

(22) PCT Filed: Jan. 19, 2006

(86) PCT No.: PCT/EP2006/000449

§ 371 (c)(1),
(2), (4) Date: Jul. 20, 2007

(87) PCT Pub. No.: WO2007/077114

PCT Pub. Date: Jul. 27, 2006

(65) Prior Publication Data

US 2008/0163462 A1 Jul. 10, 2008

(30) Foreign Application Priority Data

Jan. 21, 2005 (DE) ..... 20 2005 000 998 U
Feb. 23, 2005 (DE) ..... 20 2005 002 960 U

(51) Int. Cl.
*A45C 3/00* (2006.01)

(52) U.S. Cl. ..... 16/412; 16/110.1; 16/413

(58) Field of Classification Search ..... 16/110.1, 16/412, 413, 422; 312/222; 49/316, 319, 49/321; 292/DIG. 71, 251.5, 182

See application file for complete search history.

(56) References Cited

U.S. PATENT DOCUMENTS

| | | | | |
|---|---|---|---|---|
| 2,422,770 | A | 6/1947 | Blum | |
| 5,743,575 | A * | 4/1998 | McFarland | 292/336.3 |
| 6,375,291 | B1 * | 4/2002 | Nam et al. | 312/405 |
| 7,377,560 | B2 * | 5/2008 | Wiemer et al. | 292/251.5 |
| 2002/0013980 | A1 * | 2/2002 | Bella et al. | 16/412 |
| 2002/0148167 | A1 | 10/2002 | Muller | |
| 2003/0090187 | A1 * | 5/2003 | Kawamura et al. | 312/401 |

FOREIGN PATENT DOCUMENTS

| | | |
|---|---|---|
| CN | 1508500 | 6/2004 |
| DE | 29912563 | 11/2000 |
| EP | 1031682 | 8/2000 |
| EP | 1174668 | 1/2002 |
| EP | 1249567 | 10/2002 |
| EP | 1277899 | 1/2003 |
| EP | 1426537 | 6/2004 |
| EP | 1460205 | 9/2004 |

* cited by examiner

*Primary Examiner* — Victor Batson
*Assistant Examiner* — Jeffrey O'Brien
(74) *Attorney, Agent, or Firm* — Dilworth & Barrese, LLP.

(57) ABSTRACT

A door handle for opening a door of a refrigerator or a freezer compartment is fixable to the door in a manner pivotable by a pivot support and movable between an open position and a closed position as well having a restoration device for the automatic restoration of the handle from the open position into the closed position. A movement damper is provided for damping the restoration force of the handle from the open position into closed position and/or opening movement of the handle from the closed position into open position.

15 Claims, 4 Drawing Sheets

DOOR HANDLE FOR REFRIGERATORS AND/OR FREEZERS

BACKGROUND OF THE INVENTION

The present invention relates to a door handle for refrigerators and/or freezers for the opening of a door for a refrigerator or a freezer compartment having a handle which is fixable to the refrigerator door or freezer compartment door in a manner pivotable by a pivot support and is movable between an open position and a closed position as well having a restoration device for the automatic restoration of the handle from the open position into the closed position.

Door handles for refrigerators and/or freezers are subject to the special demand that they should permit a simple and low-force opening of the door for a refrigerator or freezer compartment which can only be moved with a very stiff motion from the closed position. Doors of refrigerators or freezer compartments as a rule stick in the closed position, which is not only due to the locking force of the magnetic seal, but above all to the high suction force which can arise due to the vacuum as a result of the air cooling. Doors of refrigerators or freezer compartments are therefore as a rule made as lever handles which are pivotably supported at the respective door.

The main function of a lever handle for doors of refrigerators or freezer compartments is the simple and low-force opening of the respective door. In this connection, it is a question of overcoming the locking force of the magnetic seal of such doors and, in particular with freezer compartment doors, of overcoming the high suction force which can arise due to the vacuum as a result of the air cooling. It has therefore already been proposed to open the doors not only by the pulling force acting on the handle, but to support the handle pivotably at the door and to connect it via a pivot transmission to a slider which presses against the door frame or the unit carcass to press the door open. The corresponding pivot movement of the handle is transmitted with a specific gear ratio to the slider so that the forces required for the opening are applied via the lever effect.

The handle is moved back automatically into the closed position from the open position by a restoration device, with the restoration device at times having to be robust since not only the moving handle alone, but also the lever mechanism connected thereto also has to be moved back with door handles of refrigerators and freezers. An unwanted noise formation arises in this connection on the opening as well as a stress on and wear of the mechanical parts.

SUMMARY OF THE INVENTION

It is therefore the underlying object of the invention to provide an improved door handle of the said kind which avoids disadvantages of the prior art and further develops the latter in an advantageous manner. An improved restoration movement of the handle into its starting position or closed position should preferably be achieved.

This object is solved in accordance with the invention by a door handle in accordance with the description herein. Preferred configurations of the invention are the subject of the invention herein.

In accordance with the invention, the door handle therefore has a movement damper which damps the restoration movement of the handle from the open position into the closed position. The handle actuates the movement damper on the restoration movement and/or on the tightening of the movement damper so that the restoration force has to overcome the restraint or damping of the movement damper. No uncontrolled snapping back of the handle takes place, but rather a gentle restoration movement with a controlled, reduced speed. If the movement damper is active on the opening, in particular in the last section of the opening movement, a gentle moving to the end point of the opening movement can moreover be achieved. Not only unwanted noise formation on the reaching of the closed position and mechanical wear are hereby avoided, but a full actuation sensation is communicated which also creates a solid and high-quality impression with components with a light weight.

The movement damper can generally be of various configurations. In accordance with an embodiment of the invention, the damper can form a piston-in-cylinder unit in which the piston moves a damping liquid, with the piston-in-cylinder unit being arranged between a stationary door handle part and a movable door handle part, in particular the handle. To create an arrangement of small construction, a rotary damper can also be provided as the movement damper in a further development of the invention, with a damper rotor being rotated with respect to a stationary damper part.

It proves to be advantageous for the frequently high temperature fluctuations for a silicone oil damper to be used as the movement damper which ensures stable operating conditions over a large temperature range and can have a range of use between −25° C. and +80° C.

In a further development of the invention, the movement damper is integrated into the handle. Specifically when a rotary damper is used, it can be arranged in the interior of the handle so that it does not become visible from the outside and does not disrupt the appearance of the handle subject to high esthetic demands.

The movement damper can generally be coupled to the handle in a variety of manners. In accordance with an embodiment of the invention, the handle has a toothed arrangement which is in engagement with a toothed driving piece for the drive of the movement damper. Said driving piece can be a part of the movement damper itself, for example it can be directly connected to the rotor of the damper when a rotary damper is used. Alternatively, a reduction gear can also be connected between the handle and the movement damper to convert a relatively small handle movement into an adequate damper movement. In this case, the said toothed driving piece can be part of this reduction gear that is coupled to the movement damper at the output side.

In a further development of the invention, the movement damper can also be supported at the movable handle and can be actuated by an actuation section, in particular by a toothed arrangement at the stationary bearing fitting supporting the handle. In this case, a reduction gear can also be correspondingly interconnected.

The handle, the restoration device, the movement damper and a door handle holder for the fastening of the door handle to the door of the refrigerator or the freezer compartment are advantageously combined to form a preassembled unit to simplify the assembly of the door handle.

The handle itself can have different designs. In accordance with an embodiment of the invention, it can be supported on a fitting part in a manner pivotable by a pivot bearing, with the door handle being able to be mounted to the door with the help of said fitting part. The handle can be configured in the manner of a rocker or of a lever and can have a pressure nose on the side of the pivot axle disposed opposite the section to be gripped, said pressure nose pressing against the carcass of the refrigerator or of the freezer compartment on the movement of the door handle into its open position and thus levering the door open.

In accordance with a special embodiment, the pivot support for the handle can define a roll center which is disposed on the inner side of the door at least for a part of the pivot movement of the handle between the open position and the closed position. Although the door handle is hinged to the outer side of the door by a pivot support arranged on the outer side of the door, the roll center or the pivot center of the door handle is disposed on the inner side of the door or inside the outer skin of the door on which the door handle and its pivot bearing are fastened. The roll center disposed on the inner side of the door permits a lower construction height of the total door handle, with a sufficient actuating path of the slider being able to be achieved without an excessively large pivot movement of the handle.

The pivot support can in particular be configured such that the roll center of the handle on its movement between the open position and the closed position moves on a path which is preferably fully disposed on the inner side of the door, in particular, however, at least in the pivot region of the door handle in which the slider presses against the counter-flank of the unit carcass on which the inner side of the door is disposed. In contrast to known solutions, the handle therefore does not have any pivot axle fixed with respect to the door. The roll center of the door handle rather moves on a path on its pulling open, with the roll center, however, being held on the inner side of the outer skin of the door. Favorable lever ratios on the conversion of the handle movement into a slider movement can hereby be achieved for different pivot positions of the door handle.

The movement damper is advantageously disposed between the center of rotation of the handle and the handle itself. With an arrangement of small construction size, a section of the handle moving around the center of rotation can itself be used for the actuation of the movement damper. A section of the handle can in particular be provided with a toothed arrangement which moves around the center of rotation on actuation of the handle and is in engagement with a toothed driving piece which drives the movement damper.

In a further development of the invention, the handle is pivotably hinged to a coupling member which is in turn pivotably hinged to the front side of the door or to a door fitting fastened thereto. The roll center disposed on the inner side and a favorable force transfer with a low construction height is achieved via this coupling member. The coupling member can in particular be rotatably supported directly, i.e. without the interposition of further coupling members, at the front side of the door or at the fitting fastened thereto, so that the pivot axle of the coupling member is fixed with respect to the door. The handle is also preferably pivotably fastened directly, without the interposition of further transmission members, to the coupling member. It is particularly advantageous here for a releasable snap connection to be provided between the handle and the coupling member. The mounting is hereby facilitated.

The movement damper is advantageously rigidly fastened to the aforesaid door fitting so that a toothed section of the handle can drive a drive pinion of the movement damper.

In a further development of the invention, the handle is likewise directly, without the interposition of gear elements, pivotably connected to the slider, with the connection between the handle and the slider preferably being configured releasably, in particular in the form of a hinged snap or latch connection. This does not only facilitate the mounting, but above all allows the slider to be able optionally to be simply decoupled and disassembled from the handle in order to make the door handle parts accessible which are disposed below the slider. The slider can in particular form a fastening screw cover so that a separate cover of the fastening elements of the door handle at the door can be omitted. For the fastening of the door handle to the door, the door handle can have a fastening plate at which both the slider and the handle can be supported. The named fastening plate itself can be mounted to the door by suitable fastening means, in particular fastening screws, with the fastening means being arranged only on the narrow side of the door in an advantageous configuration of the invention so that they can be covered by the slider. If the slider is released from the handle and disassembled, the fastening means are accessible to be able to release the fastening plate from the door.

To give the door handle, more precisely said handle, sufficient stability with respect to transverse loads which may occur in that a child hangs on the handle, the fastening plate forms a guide in which the handle is received and which stabilizes the handle in addition to its support at the slider and at the coupling member. The fastening plate can in particular have two guide surfaces which are perpendicular to the pivot axle of the handle and between which the handle is received with corresponding guide surfaces. In addition, the fastening plate can have a guide surface which curves around the pivot center of the handle and along which the handle runs.

To give the whole door handle stability with respect to the fastening to the door, in a further development of the invention, an anchor plate under the outer skin of the door can be foamed into it in a lying disposition on the narrow side of the door. The fastening screws with which the fastening plate for the handle and the slider is fastened can be screwed into this anchor plate.

In a further development of the invention, a setting device is provided for the setting of the position of the handle in the closed position relative to the door. The door handle frequently does not fit exactly to the outer contour of the door due to shape tolerances of the door. The freely projecting end of the handle should in particular be in flush contact with the front side of the door in the closed position. The handle can be precisely adjusted with the help of the named setting device until the projecting end of the handle lies exactly on the outer skin of the door.

The setting device can in particular set the angular position of the fastening plate relative to the door. An adjusting screw can preferably be provided which is arranged at the narrow side of the door and presses against the narrow side.

BRIEF DESCRIPTION OF THE DRAWINGS

The invention will be explained in more detail in the following with respect to a preferred embodiment and to associated drawings. There are shown in the drawings.

DESCRIPTION OF THE PREFERRED EMBODIMENTS

Figure 1:
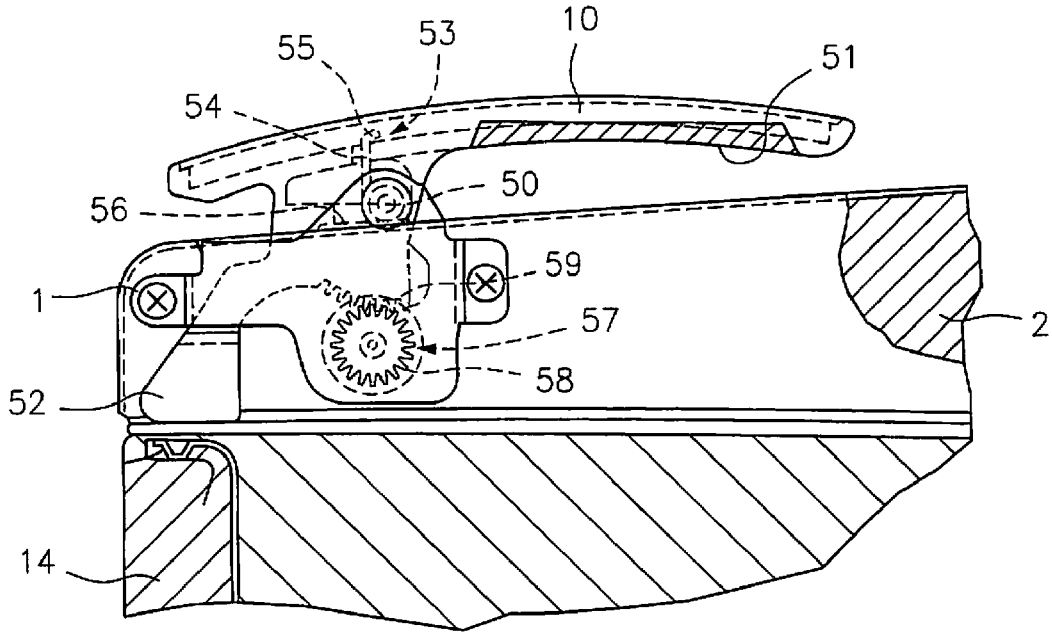
FIG. 1: a sectional view of a door handle in accordance with an advantageous embodiment of the invention mounted at a refrigerator door in a closed position.
Figure 2:
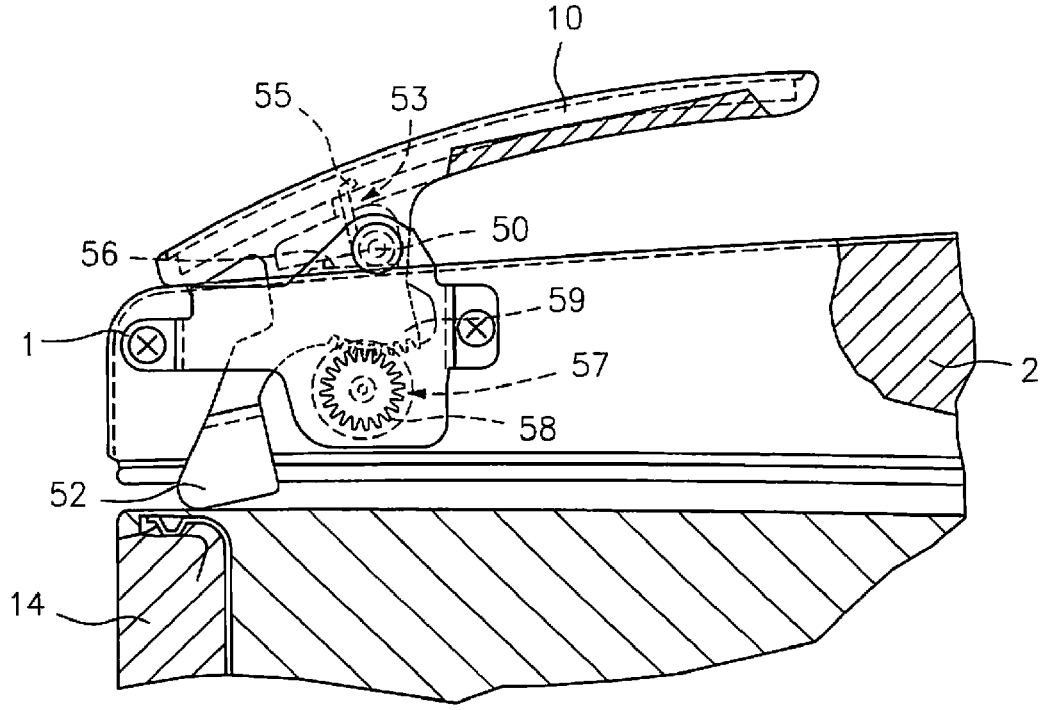
FIG. 2: a sectional view of the door handle of FIG. 1 in its open position.

The door handle shown in FIGS. 1 and 2 has a substantially plate-shaped fitting 1 which is set onto the upper side of the door 2 and is rigidly connected there by means of screws. The fitting 1 projects slightly beyond the front side of the door 2. A substantially vertical pivot axle 50, on which the handle 10 is rotatably seated, is fastened to this projecting part.

As FIGS. 1 and 2 show, the handle 10 on the side of the pivot axle 50 disposed opposite the section 51 to be gripped includes a projecting pressure nose 52 which is approximately flush with the rear side of the door 2 in the closed position of the handle 10 shown in FIG. 1. The pressure nose 52 comes to lie opposite a contour of the unit carcass 14 forming the door frame. In the closed position, the end face of the pressure nose 52 does not contact the unit carcass 14.

If the handle 10 is pulled by its gripping section 51 into its open position, as FIG. 2 shows, the pressure nose 52 presses against the said contour of the refrigerator carcass 14, whereby the door 2 is levered open with respect to the refrigerator carcass 14. Due to the pivot movement of the handle 10, the pressure nose 52 slides over the contour of the unit carcass forming the door frame. The lever ratios with respect to the pivot axle 50 are dimensioned such that the initial jamming of the door 2, which can be effected by the magnetic seal 13, but also by the vacuum forming as a result of the air cooling, can be overcome with a low force.

The handle 10 is loaded by a restoration device 53 in the form of a spring 54 which, in the embodiment drawn, is a rotary spring which extends around the pivot axle 50 and which is supported with one spring arm 55 at the handle 10 and with a second spring arm 56 at the fitting 1 (cf. FIG. 1). If the handle 10 is released in the position shown in FIG. 2, the spring 54 automatically presses the handle 10 back into its closed position, as FIG. 1 shows. To prevent an unwanted whipping or snapping back in this process, a movement damper 57 is associated with the handle 10 and the spring 54 has to overcome its damping effect on the restoration movement of the handle 10. As the Figures show, the movement damper 57 is a rotary damper which is known per se and in which a rotor is rotatably received in a stator and is damped in the rotary movement by silicone oil.

The movement damper 57 is rigidly fastened to the fitting 1 and has a drive pinion 58 as the driving piece which has an axis of rotation parallel to the pivot axle 50 of the handle 10. The drive pinion 58 in the embodiment drawn is seated directly on the rotor of the movement damper 57 to drive it. The drive pinion 58 is in toothed engagement with a toothed section 59 of the handle 10 which is provided with a matching toothed arrangement. The toothed section 59 is radially spaced apart from the pivot axle 50 so that, on an actuation of the handle 10, the toothed section 59 sweeps over the fitting 1 and drives the drive pinion 58 in this process. The handle 10 accordingly drives the movement damper 57.

If the handle 10 is released from the open position shown in FIG. 2, the spring 54 presses it back into the closed position, as FIG. 1 shows. In this connection, the toothed section 59 of the handle 10 drives the movement damper 57. The latter damps the restoration movement of the handle 10 so that it moves to its starting position with delay so no audible impact arises when the starting position is reached. The perceived value of the handle is hereby substantially increased. When different materials of the handle in accordance with the damper are used, a precise restoration force can be fixed.

Figure 3:
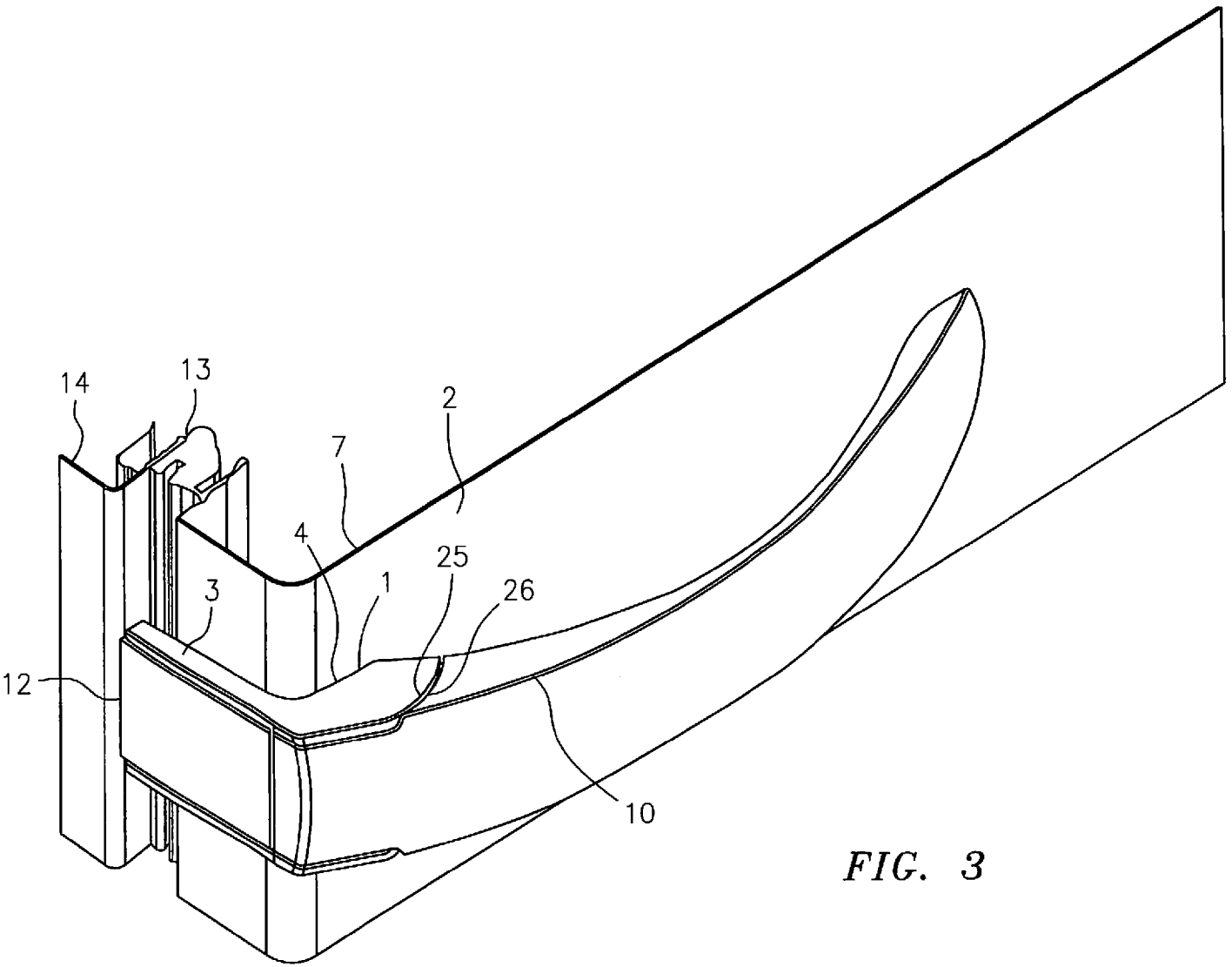
FIG. 3: a perspective view of a door handle in accordance with a preferred embodiment of the invention mounted at a refrigerator door shown sectionally.
Figure 4:
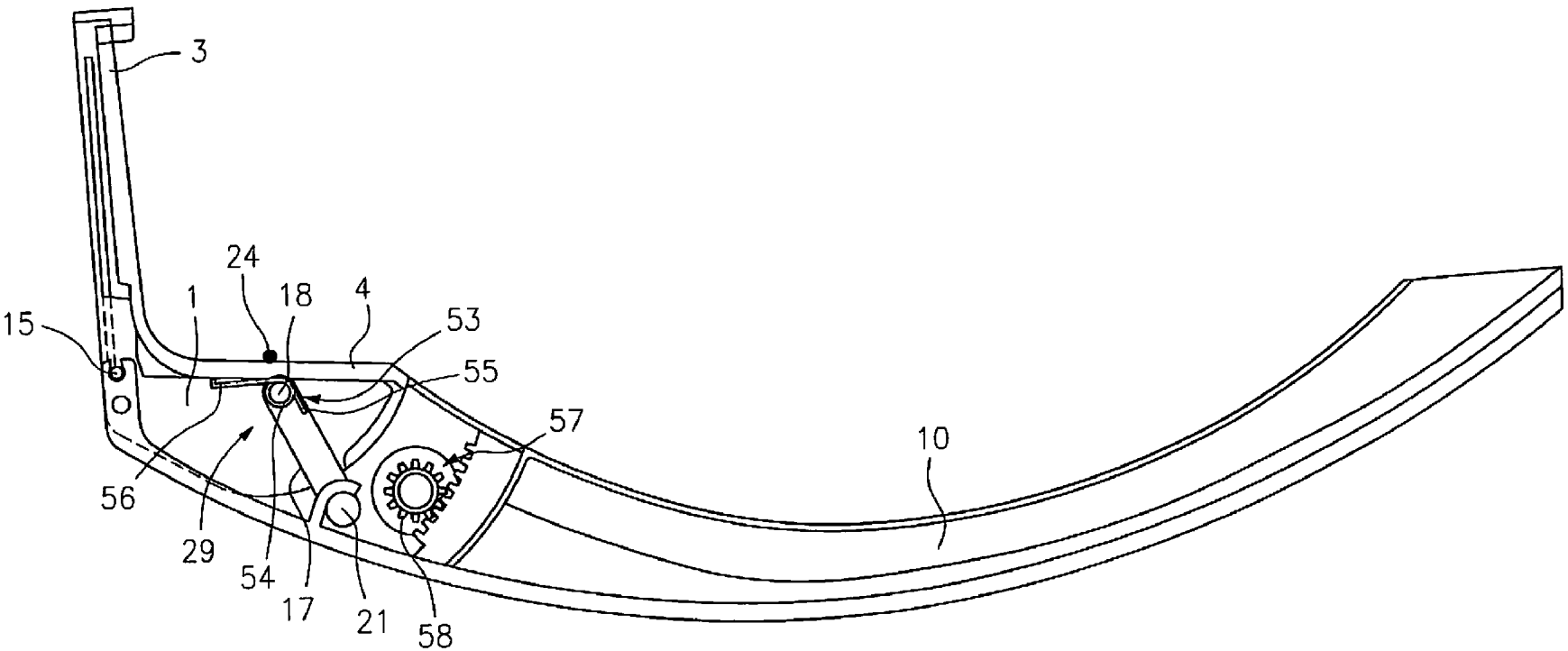
FIG. 4: a sectional view of the door handle of FIG. 3 in rest position or closed position.
Figure 5:
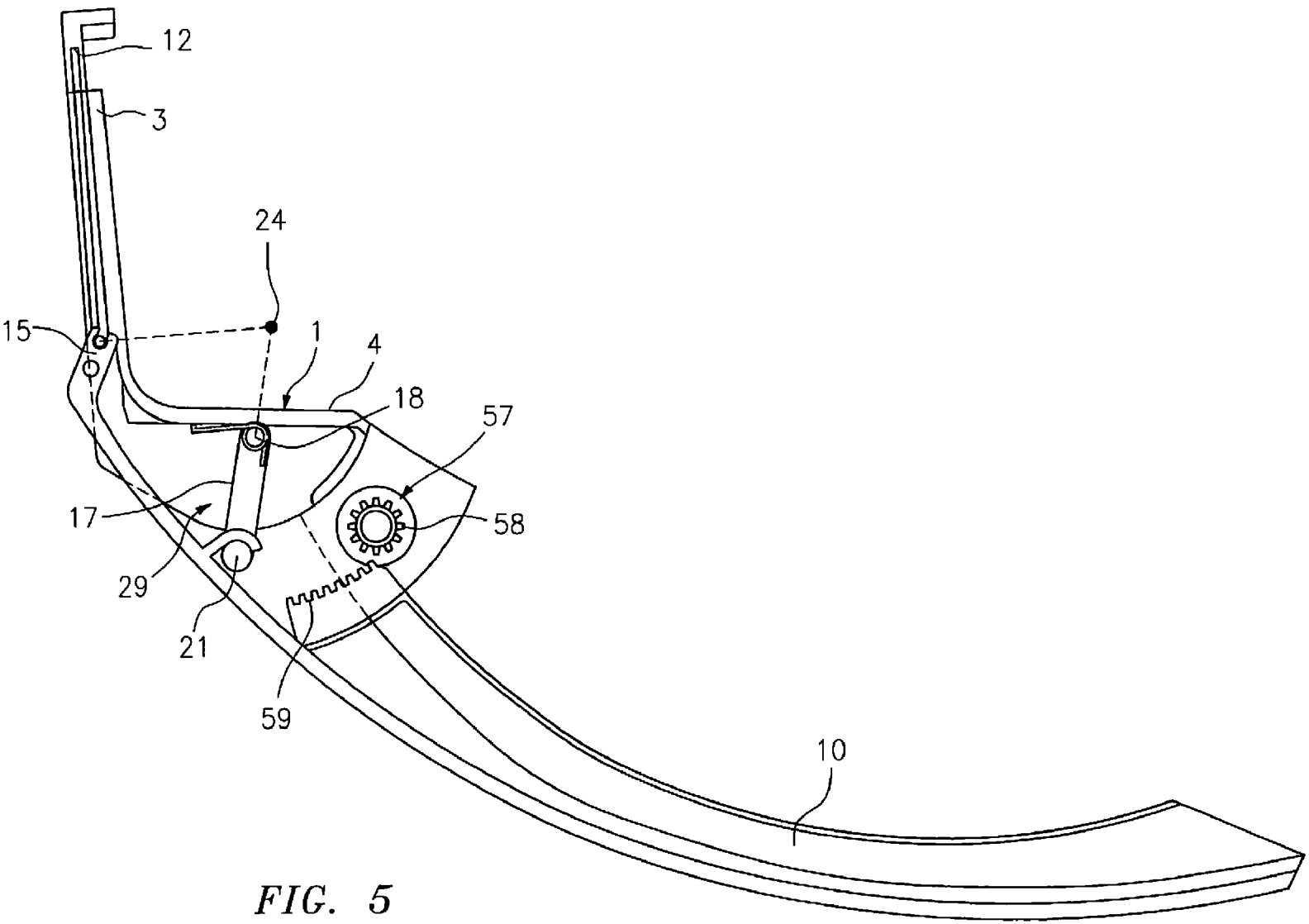
FIG. 5: a sectional view of the door handle of FIG. 3 with the door handle being in an open position.

The door handle shown in FIGS. 3 to 5 includes a plate-like fitting 1 which has two limbs angled with respect to one another such that the fitting can be set onto the door 2 from both sides. As FIG. 3 shows, a first limb 3 of the fitting 1 can be set onto the narrow side of the door and a second limb 4 can be set onto the front side of the door. The fitting 1 is fixedly screwed to the door by means of fastening screws. All fastening screws are provided at the first limb 3 and and be screwed into the narrow side of the door 2.

A slider 12 is displaceably supported at the fitting 1 and the door can be pressed open with economical force with its aid. The slider 12 is arranged at the narrow side of the door 2 and is displaceably guided at the limb 3 of the fitting 1 at the narrow side of the door. The limb 3 of the fitting 1 advantageously has two longitudinal guide means in the form of longitudinal webs or longitudinal grooves into which the slider 12 is inserted with complementary longitudinal grooves or longitudinal webs. The slider 12 is displaceable parallel to the narrow side of the door substantially perpendicular to the plane of the door 2.

As FIG. 3 shows, the slider 12 projects over the inner contour of the door 2 in the closed position of the handle 10 and extends in the region of the magnetic seal 13 toward the contour of the unit carcass 14 forming the door frame. In the closed position, the front face or the pressure button 12*a* of the slider 12 does not abut the unit carcass 14.

The slider 12 can be actuated by the handle 10 which is pivotably supported at the fitting 1 for this purpose. In more precise terms, the handle 10 is hingedly connected to the slider 12, on the one hand, and is pivotally hinged to the fitting 1, on the other hand. As FIGS. 4 and 5 show, the hinged connection 15 between the handle 10 and the slider 12 is made as a releasable snap connection. The handle 10 and the slider 12 have complementary latching means in the form of a resilient, fork-like socket having a groove-like recess as well as a complementary bead-like joint head. The joint axis around which the handle and the slider can be tilted relative to one another extends perpendicular to the displacement axis of the slider 12 and substantially parallel to the narrow side of the door.

On the other hand, the handle 10 is pivoted at the second limb 4 of the fitting 1 on the front side of the door spaced apart from the joint connection 15 and indeed by means of a coupling member 17 which is configured as rigid and is in turn pivotably hinged to the limb 4 of the fitting 1. As FIG. 4 shows, the coupling member 17 is rotatably fastened to the limb 4 around a substantially vertical pivot axis 18. In the embodiment drawn, a fastening part is provided which supports the pivot axle 18 and to which the limb 4 is fixedly screwed, and indeed by means of a fastening screw. The pivot axle 18 is disposed substantially directly at the front side of the door or of the limb 4 of the fitting 1 secured thereto.

At its other end, the coupling member 17 is pivotably connected to the handle 10, with the joint connection 21 likewise being configured as a releasable snap connection. The pivot axis defined by the joint connection 21 between the handle 10 and the coupling member 17 is parallel to the pivot axis 18.

The pivot capability of the coupling member 17 is advantageously bounded by abutments with respect to the fitting 1, with the abutments being able to be realized on the fastening part 19. It is, however, understood that other pivot boundings are also possible.

As FIG. 5 shows, the arrangement and configuration of the coupling member 17 are made such that the longitudinal axis of the coupling member 17 extends substantially perpendicular to the front side of the door 2 when the handle 10 is in its open position. When the handle 10 is in its rest position or closed position in accordance with FIG. 4, the longitudinal axis of the coupling member 17 extends away from the front side of the door at an acute angle, with it being inclined toward the free end of the handle 10 (cf. FIGS. 2 and 4). To achieve an arrangement of low construction, the coupling member 17 extends in the interior of the handle 10. The joint connection 21 is disposed substantially directly at the inner side of the wall of the handle 10 forming the front side (cf. FIG. 4).

The arrangement of the coupling member 17 and its alignment relative to the joint connection 15 of the handle 10 at the slider 12 are made such that, as FIGS. 2 to 4 show, the roll center 24 or the pivot center of the handle 10, around which it is effectively pivotable relative to the door, is disposed on the inner side of the door 2 although the whole pivot support is fastened and arranged on the outer side of the door. On the one hand, this allows a very shallow construction height and, on the other hand, favorable gear ratios to convert the movement of the handle and the forces acting on it into a movement of the slider 12 and the pressure forces effecting it.

As FIGS. 4 and 5 show, a movement damper for the damping of the door handle movement is also provided in this embodiment in a similar manner to the previously described embodiment. The movement damper 57 is rigidly fastened to the fitting 1 and is seated at the end of the limb 4 of the fitting 1 facing the handle 10. The movement damper 57 is also a rotary damper here having a drive pinion which can be driven around an axis parallel to the pivot axes of the coupling member 17.

The handle 10 has at its inner side a toothed section 59 which is shaped such that it moves into engagement with the drive pinion 58 and drives it on the opening movement and closing movement of the handle 10. As FIG. 4 shows, the movement damper 57 is received in the interior of the handle 10 at least in its closed position or is arranged in the inner space which is bounded by the handle 10 and by the fitting 1. The toothed section 59 can be configured such that it moves out of engagement with the drive pinion 58 in the completely open position of the handle 10. It is, however, configured such that it moves back into engagement with the drive pinion 58 during the restoration movement to damp the restoration movement in the previously described manner.

A spring 54 is also provided in the embodiment in accordance with FIGS. 3 to 5 as a restoration device 53 for the automatic restoration of the handle 10. Said spring can load the coupling member 17 in the embodiment drawn and can press the handle 10 into is closed position via it. As FIG. 4 shows, the spring 54 can also be a rotary spring or a helical spring here which is supported with one spring limb 55 at the coupling member 17 and with the other spring limb 56 at the fitting 1.

As FIG. 3 shows, the handle 10 is not only supported at the slider 12 via the coupling member 17 and the joint connection 15 for the stable support thereof, but is also supported at the fitting 1 via guide surfaces. As FIG. 1 shows, the fitting 1 has two parallel guide webs 25 which are perpendicular to the pivot axis of the handle 10 and between which the handle 10 is received. In this connection, the handle 10 has corresponding guide surfaces 26 with which it slides on the inner sides of the guide webs 25.

As FIG. 4 shows, the joint connection 21 between the handle 10 and the coupling member 17 is configured such that traction can be transferred from the coupling member 17 to the handle 10. The coupling member 17 acts as a traction member which converts the traction force exerted on the handle 10 into a compression force onto the slider 12.

To be able do dismantle the door handle, the snap connection 15 between the slider 12 and the handle 10 is released so that the slider 12 can be pulled of and dismantled. This makes the fastening screws of the fitting 1 accessible.

The invention claimed is:

1. A door handle for refrigerators or freezers for the opening of a door (2) of a refrigerator or freezer compartment having a handle (10) which is fixable to the door (2) in a manner pivotable by a pivot support (50; 29) arranged at the outer side of the door (2) and movable between an open position and a closed position, a pressure piece for the levering open of the door (2), said pressure piece having a slider (12) which is displaceably supported at the narrow side of the door (2), hingedly connected to the handle (10), said slider can be pressed by a movement of the handle (10) against a door frame or unit carcass into the open position for the levering open of the door (2), said pivot support (50; 29) having a coupling member (17) which is pivotably connected to the handle (10) about a first pivot axis (21) and hinged to the front side of the door or to a fitting (1) fastened thereto about a second pivot axis (18), a releasable snap connection, comprising a third pivot axis (15), provided between the handle (10) and the slider (12), wherein said first pivot axis (21), said second pivot axis (18) and said third pivot axis (15), define a roll center (24) around which the handle is effectively pivotable relative to the door (2), said roll center (24) being disposed on an inner side of the door (2) for at least a part of the movement of the handle (10) between the open and closed positions with said pivot support being fastened and arranged on an outer side of the door (2), said roll center (24) providing for a shallow construction height of the total door handle, with a sufficient actuating path of the slider (12) achieved without an excessively large pivot movement of the handle (10), a restoration device (53) for the automatic restoration of the handle (10) from the open position into the closed position, a movement damper (57) for damping the restoration force of the handle (10) from the open position into the closed position and an opening movement of the handle (10) from the closed position into the open position, said handle (10) having a toothed arrangement (59), said damper (57) having a toothed driving piece (58) configured to engage said toothed arrangement (59) during restoration or closing movement of said door (2) to dampen restoration movement, said toothed arrangement (59) and said toothed driving piece (58) move out of engagement with one another in a completely open position of the handle (10).

2. A door handle in accordance with claim 1, wherein the movement damper (57) is a rotary damper.

3. A door handle in accordance with claim 1, wherein the movement damper (57) is a silicone oil damper.

4. A door handle in accordance with claim 1, wherein the movement damper (57) is integrated into the handle (10), and preferably arranged in the inner space formed by the handle (10) and the fitting (1) supporting the handle (10).

5. A door handle in accordance with claim 1, wherein the handle (10), the restoration device (53), the movement damper (57) and the fitting (1) form a unit which can be pre-assembled for the fastening of the door handle to the door.

6. A door handle in accordance with claim 1, wherein the pivot support (29) is configured such that the roll center (24) of the handle (10) moves on a path which is fully disposed on the inner side of the door (2) during movement of said handle between the open and closed positions.

7. A door handle in accordance with claim 1, wherein the movement damper (57) is arranged between the roll center (24) of the handle (10) and the handle (10) itself.

8. A door handle in accordance with claim 1, wherein the handle (10) is pivotably connected to the slider (12) without the interposition of gear elements.

9. A door handle in accordance with claim 1, wherein the slider (12) and the handle (10) are supported on the fitting (1) which can be fastened to the door (2).

10. A door handle in accordance with claim 2, wherein the movement damper (57) is a silicone oil damper.

11. A door handle in accordance with claim 10, wherein the movement damper (57) is integrated into the handle (10), and preferably arranged in the inner space formed by the handle (10) and the fitting (1) supporting the handle (10).

12. A door handle in accordance with claim 2, wherein the movement damper (57) is integrated into the handle (10), and preferably arranged in the inner space formed by the handle (10) and the fitting (1) supporting the handle (10).

13. A door handle in accordance with claim 3, wherein the movement damper (57) is integrated into the handle (10), and preferably arranged in the inner space formed by the handle (10) and the fitting (1) supporting the handle (10).

14. A door handle in accordance with claim 5, wherein said fitting (1) comprises two distinct limbs (3, 4) angled with respect to one another, and with said damper (57) rigidly fastened to said fitting (1) and seated at an end of one (4) of said limbs (3, 4) facing said handle (10).

15. A door handle for refrigerators or freezers for the opening of a door (2) of a refrigerator or freezer compartment having a handle (10) which is fixable to the door (2) in a manner pivotable by a pivot support (50; 29) arranged at the outer side of the door (2) and movable between an open position and a closed position, said handle (10) including a plate fitting (1) having a first limb (3) and a second limb (4), wherein the first limb (3) is angled with respect to the second limb (4), and wherein the first limb (3) is set on a narrow side of the door (2) and the second limb (4) is set on a front side of the door (2), the plate fitting (1) being fixedly screwed to the door (2), a pressure piece for the levering open of the door (2), said pressure piece having a slider (12) which is displaceably supported at the narrow side of the door (2), hingedly connected to the handle (10), said slider can be pressed by a movement of the handle (10) against a door frame or unit carcass into the open position for the levering open of the door (2), wherein said pivot support (50; 29) for said handle (10) includes a coupling member (17) which is pivotably hinged to said handle (10) about a first pivot axis (21) and a front side of the door (2) or a fitting (1) fastened thereto about a second pivot axis (18), a releasable snap connection comprising a third pivot axis (15), provided between the handle (10) and the slider (12), wherein said first pivot axis (21), said second pivot axis (18) and said third pivot axis (15), define a roll center (24) around which the handle (10) is effectively pivotable, said roll center (24) being disposed on an inner side of the door (2) for at least part of the pivot movement of the handle (10) between the open and closed positions, with said pivot support being fastened and arranged on an outer side of the door (2), said roll center (24) providing for a shallow construction height of the total door handle, with a sufficient actuating path of the slider (12) achievable without an excessively large pivot movement of the handle (10), a restoration device (53) for the automatic restoration of the handle (10) from the open position into the closed position, a movement damper (57) for damping the restoration force of the handle (10) from the open position into the closed position and an opening movement of the handle (10) from the closed position into the open position.

* * * * *